US007367867B2

(12) United States Patent
Boller

(10) Patent No.: US 7,367,867 B2
(45) Date of Patent: May 6, 2008

(54) TWO-SIDE WORKING MACHINE

(75) Inventor: Hans-Peter Boller, Fockbek (DE)

(73) Assignee: Peter Wolters AG, Rensburg (DE)

( * ) Notice: Subject to any disclaimer, the term of this patent is extended or adjusted under 35 U.S.C. 154(b) by 0 days.

(21) Appl. No.: 11/623,761

(22) Filed: Jan. 17, 2007

(65) Prior Publication Data

US 2008/0038989 A1 Feb. 14, 2008

(30) Foreign Application Priority Data

Aug. 10, 2006 (DE) ..... 10 2006 037 490

(51) Int. Cl.
*B24B 49/00* (2006.01)

(52) U.S. Cl. ..... 451/8; 451/41; 451/60; 451/262; 451/268; 451/285; 451/287

(58) Field of Classification Search ..... 451/8, 451/41, 60, 262, 268, 285, 287
See application file for complete search history.

(56) References Cited

U.S. PATENT DOCUMENTS

| | | | | |
|---|---|---|---|---|
| 4,860,498 | A * | 8/1989 | Gosis | 451/11 |
| 5,782,678 | A * | 7/1998 | Cesna et al. | 451/269 |
| 6,299,514 | B1 * | 10/2001 | Boller | 451/262 |
| 7,101,258 | B2 * | 9/2006 | Ising | 451/7 |
| 2006/0040589 | A1 | 2/2006 | Ising | 451/8 |

FOREIGN PATENT DOCUMENTS

| | | |
|---|---|---|
| DE | 690 24 681 T2 | 6/1996 |
| DE | 199 37 784 A1 | 2/2001 |
| DE | 102 29 941 A1 | 12/2003 |

* cited by examiner

*Primary Examiner*—Joseph J. Hail, III
*Assistant Examiner*—Shantese L McDonald
(74) *Attorney, Agent, or Firm*—Vidas, Arret, & Steinkraus

(57) ABSTRACT

A two-side working machine, comprising an upper and a lower working disc which hold on, and are fixed to, an upper and a lower carrier disc, and which are disposed coaxially with each other and are adapted to be rotationally driven relative to each other by a working motor via a driving shaft, wherein the working discs have formed therebetween a working gap in which flat workpieces are processed on both sides, and a distance measuring device which measures the distance between working discs in at least two radially spaced points of the working gap, whereby the upper carrier disc is suspended on a supporting ring which is connected to the upper working shaft so as to be fixed for rotation, an annular portion of the carrier disc and means which are externally controllable by the supporting ring and via which a radial force is applied to the circumference of the carrier disc about the circumference of the supporting ring by means of a force generator, and control means are provided which adjust the force on the force generator in dependence on the distance values measured by the distance measuring device or the pressure values measured by a force sensing device, respectively.

9 Claims, 2 Drawing Sheets

TWO-SIDE WORKING MACHINE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

What is understood by a two-side working machine is a machine which has an upper and a lower working disc between which flat workpieces are machined which are to be provided with parallel-plane surfaces. Machines of this type serve for polishing, lapping or even grinding.

A two-side grinding machine has become known from DE 102 29 941 A1, the entire contents of which are incorporated herein by reference, for example. Two-side grinding machines have also been known from DE 199 37 748 A1, the entire contents of which is incorporated herein by reference, or DE 690 24 681 T2, the entire contents of which is incorporated herein by reference.

From US 2006/0040589 A1, the entire contents of which is incorporated herein by reference, it has become known to measure the gap distance in at least two radially spaced points by means of a suitable distance measuring device, and to regulate the supply of the coolant to the working discs in dependence on the values measured.

Since the workpieces are moved within the gap between the upper and lower working discs their geometry is significantly determined by the geometry of the working discs. Stability of temperature during the working process is an important criterion for manufacturing high-quality workpieces. This is why the temperature needed in working is set inside a labyrinth which is arranged between the carrier disc and working disc and in which a coolant is circulated. Normally, temperature-controlled water is pumped through the channel system which is installed.

The common construction of such working machines provides that the working disc proper bears on a carrier disc which, in turn, is coupled to a shaft which is set into rotation by an appropriate driving motor. Since temperature conditions vary on the working disc the disc will get deformed and causes an irregular working gap. Although the distance measurement mentioned allows to ascertain the occurrence of such a deformation it is not always possible to compensate such deformations by adequately influencing the temperature or purposefully cooling the disc.

Therefore, it is the object of the invention to provide a two-side working machine which helps achieve an intentional deformation of the upper working disc, particularly for leveling out undesirable variations of the working gap as a result of a deformation of the working disc.

BRIEF SUMMARY OF THE INVENTION

In the inventive two-side working machine, the upper carrier disc is suspended on a supporting ring which is connected to the upper working shaft so as to be fixed for rotation. As is known the upper working disc is pushed towards the lower working disc at a certain pressure in order to apply a desired force to the workpieces while working them. The suspension of the carrier disc and, hence, the upper working disc has to ensure that such a pressure onto the working disc can be generated from the shaft.

Further, according to the invention, a controllable means is disposed between the supporting ring and an annular portion of the carrier disc on the radially outer side of the supporting ring, via which a radial force is applied to the carrier disc by means of a force generator via the circumference of the supporting ring. A force, when applied in the manner described, makes it possible to change a working surface of the working disc that initially is flat into a surface which is slightly concave. Conversely, it is possible to shape a working disc which initially is slightly concave into a planar or concave working disc by the application of a predetermined pressure.

Finally, the invention has provided therein a regulation device which adjusts the force on the force generator in dependence on the distance values measured by the distance measuring device.

The inventive solution helps in infinitely varying the convexity or concavity of the upper working disc. Moreover, it becomes possible to convert a convex shape prepared for the working discs (e.g. by lapping them) into a concave shape thereof. Thus, the invention permits to adjustably adapt the working gap prior to any polishing travel and also during the polishing travel independently of a gap which was prepared mechanically.

According to an aspect of the invention, a provision is made for the annular portion to be axially extended upwardly from the remainder of the carrier disc. Therefore, the annular portion may be some sort of axial, annular collar which is attacked by the force of the force generator in order to deform the working disc. Such force may be applied at circumferential spacings or even continuously across the periphery.

Various constructional options are conceivable to apply a radially outward force between the supporting ring and the annular portion of the carrier disc. In this regard, an aspect of the invention provides that a small-width annular channel, which is circumferential in a peripheral direction, is formed between the supporting ring and the annular portion, and that the force generator is a pressure generator which communicates with the annular channel and produces a predetermined pressure inside the annular channel. Preferably, the annular channel is relatively narrow and preferably is an annular slot which is sealed, however, towards all sides, specifically downwardly and upwardly. The arrangement of the annular slot or area of the annular portion that faces the annular channel preferably is such that this area approximately rests on the middle of the radial width of the annular working face of the carrier disc.

The pressure to be generated within the annular channel preferably is produced hydraulically with water being preferably used as a hydraulic medium. The supply may be performed via a rotary transfer device and the shaft driving the upper disc, which can be realized readily, however. Though, it is preferred to employ a pressure transducer (booster) on the supporting ring that transforms a pneumatic pressure into an intensified hydraulic pressure and interacts with a cylindrical bore in the supporting ring. The supply of the regulated compressed air is via a revolving distributor. The cylindrical bore communicates with the annular channel through a cross-bore. Below the piston and annular channel, the cylindrical bore has accommodated therein a hydraulic medium which preferably is water. The piston is driven by an externally generated pressure which may originate from any pneumatic pressure source.

The essential point is that the pressure is controllable in order that the desired deformation may be achieved precisely.

As mentioned, it is necessary to determine the geometry of the working gap to allow for the control of the force and pressure generators. Suitable sensors as are known as such may be utilized for this purpose, e.g. vortex flow sensors, temperature sensors, pressure sensors, etc.

BRIEF DESCRIPTION OF THE SEVERAL VIEWS OF THE DRAWINGS

The invention will be described in more detail below with reference to the embodiments shown in the drawings.

DETAILED DESCRIPTION OF THE INVENTION

Figure 1:
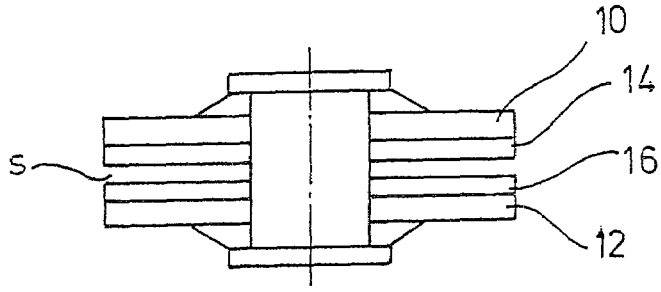
FIG. 1 schematically shows the structure of a conventional two-side working machine.

While this invention may be embodied in many different forms, there are described in detail herein a specific preferred embodiment of the invention. This description is an exemplification of the principles of the invention and is not intended to limit the invention to the particular embodiment illustrated FIG. 1 illustrates an upper carrier disc 10 and a lower carrier disc 12 which are coupled each to a shaft of a rotary drive, which fact is not shown. Firmly coupled to the carrier discs 10, 12 is a working disc 14, 16 with the discs 10, 14 and 12, 16 resting planarly against each other. The working discs may serve for lapping, grinding or polishing. They have a respective structure or work lining, which fact is known as such, however. Furthermore, the carrier discs 10, 12 may be provided with an appropriate channel system in order to cool the working discs 14, 16. As is known an elevated temperature will arise during the working process and, under certain circumstances, will result in the fact that the gap s between the working discs 14, 16 assumes different values via the radius from the inside to the outside. The width of the gap always has to be the same from the inside to the outside in order to ensure that workpieces undergo plane-parallel grinding.

Figure 2:
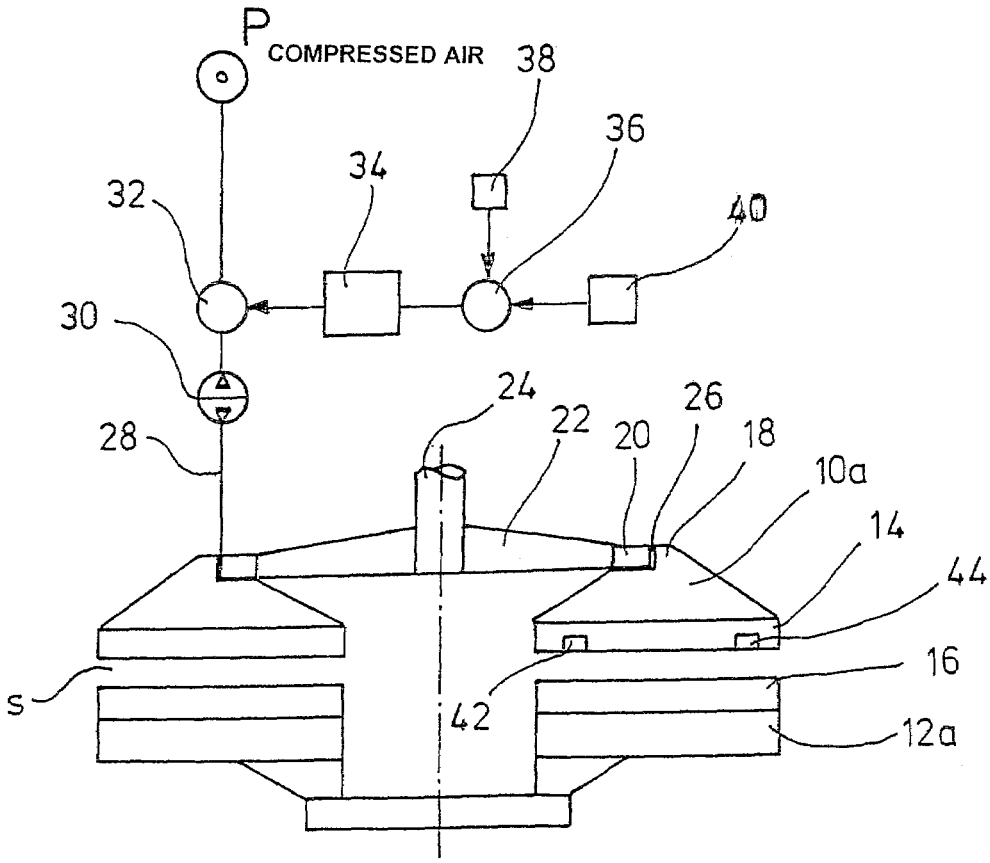
FIG. 2 very schematically shows the structure of an inventive two-side working machine.

In FIG. 2, the upper and lower working discs 14, 16 are coupled each to a special carrier disc 10*a* and 12*a*. The upper carrier disc 10*a* has an upright annular portion 18 approximately in the middle of the radial extension of its working surface. Within the annular portion 18, a supporting ring 20 is located and is coupled to the upper shaft 24 of the rotary drive via arms 22 arranged in a star shape. The carrier disc 10*a* is suspended on the supporting ring via means which are not shown in FIG. 2 so that a rotation of the shaft 24 also implies a rotation of the working disc 14 in this way.

An annular slot 26 is defined between the supporting ring 20 and annular portion 18. The annular slot is sealed and communicates with the channel 28. The channel is in communication with a pressure transducer 30 which is fed with a variable pressure from a proportional valve 32. The representation only is schematic. It intends to outline that the pressure transducer 30 and the proportional valve 32 may help generate and maintain a predetermined pressure inside the annular slot 26. The proportional valve 32 is triggered via a governor 34 which is coupled to a desired and actual values comparator. A desired value of the gap distance s is predetermined by the block 38 and an actual value of the gap distance s, which is measured by means of two sensors 42 and 44 embedded in the working disc 14, is inputted by the block 40. It is understood that if the working disc 14 deforms via the radius a uniform distance cannot be measured, but differences in distance may be determined instead which as is shown in FIG. 2 cause a more or less large pressure to be generated in the annular slot 26.

Figure 3:
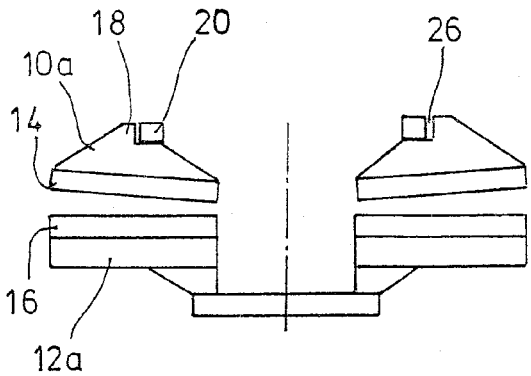
FIG. 3 shows a convex deformation of the upper working disc of the machine in FIG. 2.
Figure 4:
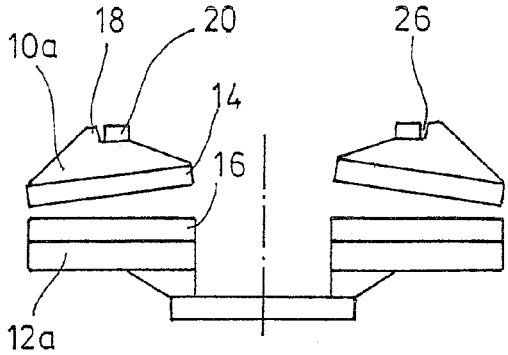
FIG. 4 schematically shows the concave deformation of the upper working disc of the working machine in FIG. 2.

FIG. 3 shows the way the upper working disc 14 assumes a convex shape. It is understood that the representation is exaggerated very much. Such convexity ranges within gap width differences in the μ range with respect to the lower working disc 16. FIG. 4 shows the way the deformation described for the upper carrier disc 10*a* and, hence, the upper working disc causes the disc to assume a concave shape now. For example, the convex shape can be imparted to the upper disc from the very beginning. The shape is compensated or excessively compensated by applying a corresponding pressure to the interior of the annular slot 26, depending on the gap widths measured.

Figure 5:
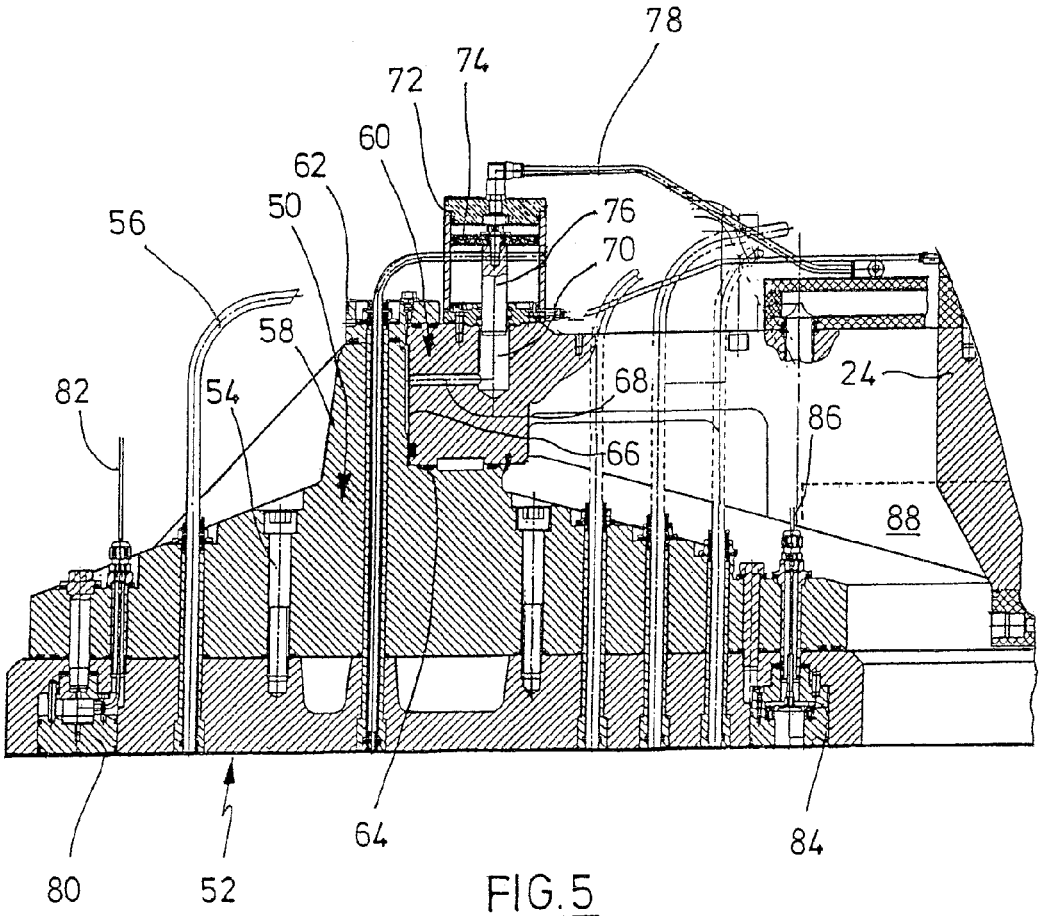
FIG. 5 shows some portion of the upper working disc of another embodiment of the inventive working machine in a constructional implementation for deforming the upper working disc.

FIG. 5 illustrates an upper carrier disc 50 for the upper working disc 52 in a section. The working disc 52 is mounted on the carrier disc 50 by means of screw bolts 54. This is known as such. Both the carrier disc 50 and working disc 52 are traversed by vertical channels oriented to each other, which communicate with conduits 56 for the supply of a lapping medium. As has the carrier disc of the machine in FIGS. 2 to 4, the carrier disc 50 has an upright annular portion 58. The radially inner side of the annular portion 58 has disposed thereon a supporting ring 60. Bolted to the upper side of the annular portion 58 is a retaining ring 62. The retaining ring 62 holds the supporting ring 60 in the position shown in an abutment against the side of the annular portion 58 facing it and the step 64 which is defined by the annular portion 58. The supporting ring 60 is sealed in its abutting surfaces by single gaskets which are not indicated. An annular slot 66 is defined between the radially outer surface of the supporting ring and the radially inner surface of the annular portion 58. This annular slot 66 is sealed by means of the gaskets described. It is in communication with an axially parallel bore 70 via a transversely extending channel 68 in the supporting ring 60.

Seated on the supporting ring 60 is a pressure booster 72 in which a piston 74 is arranged. The bore 70 is engaged by a piston rod 76 of the piston. The annular slot 66 accommodates a hydraulic medium, e.g. water. If the piston 74 is forced into the bore 70 under a pressure a predetermined pressure is generated in the annular slot 66. The result of this pressure is that a deformation force is applied to the carrier disc 50 and, hence, the working disc 52 via the annular portion 58 and will lead to a deformation as was described already above with reference to FIGS. 2 to 4.

The piston 74 may be regulated in a hydraulic or preferably a pneumatic fashion. To this end, the cylinder 72 has connected thereto a conduit 76. The conduit 76 communicates with an appropriate pressure generator or an appropriate pressure source in order to generate a predetermined pressure onto the piston 74 and, thus, a predetermined pressure inside the annular slot 66. The pressure is regulated between the upper and lower working discs in response to the gap s which was measured.

In FIG. 5, two different sensors are outlined for measuring the gap width s. Seated radially outwards in the working disc 52 is a pressure gauge 80. The gauge measures the pressure which is exerted by the working disc onto the workpieces, which are not shown. The pressure values are connected to the governor through a line 82 in order that the deformation described for the upper working disc 52 may be caused in response to the pressure values.

Also seated radially inwards is a force sensor 84 which determines the pressure acting on the workpieces and, in a combination with the force sensor 80, thus allows to conclude the respective distance between discs indirectly via the pressure. The values measured are transmitted to the previously mentioned governor through a line 86. Another possible option of indirect measurement may be realized via temperature sensors which are mounted radially inwards and outwards similarly to the force sensors. It is natural that the distance "S" may also be measured directly via vortex flow sensors.

As can be further seen in FIG. 5, the driving shaft outlined at 24 is fixedly connected to the supporting ring 60 via multiple arms arranged in a star shape. One arm is outlined at 88.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A two-side working machine, comprising an upper working disc engaged to an upper carrier disc and a lower working disc engaged to a lower carrier disc, the upper working disc and the lower working disc being disposed coaxially with each other and being adapted to be rotationally driven relative to each other by a working motor via a driving shaft, wherein the working discs have formed therebetween a working gap in which flat workpieces are processed on both sides, and a distance measuring device which measures the distance between working discs in at least two radially spaced points of the working gap, characterized in that the upper carrier disc is suspended on a supporting ring which is connected to the upper working shaft so as to be fixed for rotation, an annular portion of the upper carrier disc and force generating means which are externally controllable by the supporting ring and via which a radial force is applied to the circumference of the carrier disc about the circumference of the supporting ring, and control means are provided which adjust the force on the force generating means in dependence on the distance values measured by the distance measuring device or the pressure values measured by a force sensing device, respectively.

2. The two-side working machine according to claim 1, characterized in that the annular portion is axially extended upwardly from the carrier disc.

3. The two-side working machine according to claim 1, characterized in that the radial force is applied to the annular portion in the manner selected from the group consisting of being continuously distributed and at circumferential spacings.

4. The two-side working machine according to claim 1, characterized in that the distance measuring device is equipped with vortex flow sensors for indirect measurements by temperature and/or pressure sensors.

5. A two-side working machine, comprising an upper working disc engaged to an upper carrier disc and a lower working disc engaged to a lower carrier disc, the upper working disc and the lower working disc being disposed coaxially with each other and being adapted to be rotationally driven relative to each other by a working motor via a driving shaft, wherein the working discs have formed therebetween a working gap in which flat workpieces are processed on both sides, and a distance measuring device which measures the distance between working discs in at least two radially spaced points of the working gap, characterized in that the upper carrier disc is suspended on a supporting ring which is connected to the upper working shaft so as to be fixed for rotation, an annular portion of the upper carrier disc and force generating means which are externally controllable by the supporting ring and via which a radial force is applied to the circumference of the carrier disc about the circumference of the supporting ring, and control means are provided which adjust the force on the force generating means in dependence on the distance values measured by the distance measuring device or the pressure values measured by a force sensing device, respectively, the two-side working machine further characterized in that a small-width annular channel, which is circumferential in a peripheral direction, is formed between the supporting ring and the annular portion and the force generator is a pressure generator which communicates with the annular channel and produces a predetermined pressure inside the annular channel.

6. The two-side working machine according to claim 5, characterized in that the annular channel is an annular slot.

7. The two-side working machine according to claim 5, characterized in that the annular surface of the annular portion that faces the annular channel is located approximately in the centre of the radial working width of the annular supporting disc.

8. The two-side working machine according to claim 5, characterized in that the supporting ring has disposed thereon a cylinder including a piston, the piston interacts with a cylindrical bore in the supporting ring that communicates with the annular channel via a cross-bore, and a hydraulic medium is accommodated inside the annular channel and cylinder bore.

9. The two-side working machine according to claim 8, characterized in that the piston can be operated by a controllable pressure of a hydraulic source.

* * * * *